US005402619A

United States Patent [19]

Nelson et al.

[11] Patent Number: 5,402,619

[45] Date of Patent: Apr. 4, 1995

[54] TIN-TIE BENDING MACHINE

[75] Inventors: Scott L. Nelson; Stan W. Drietz, both of Worthington, Minn.

[73] Assignee: Bedford Industries, Inc., Worthington, Minn.

[21] Appl. No.: 167,466

[22] Filed: Dec. 14, 1993

Related U.S. Application Data

[63] Continuation-in-part of Ser. No. 122,107, Sep. 16, 1993.

[51] Int. Cl.[6] ..... B65B 7/02; B65B 51/04

[52] U.S. Cl. ..... 53/76; 53/70; 53/71; 53/138.4; 53/417; 53/480; 493/19; 493/214

[58] Field of Search ..... 53/76, 71, 70, 69, 67, 53/64, 417, 416, 480, 481, 482, 476, 75, 138.4, 138.3, 138.2, 138.1, 138.7, 138.8, 138.6, 139.4, 284.7, 285, 374.4, 374.5, 374.6, 376.2; 493/19, 18, 23, 214

[56] References Cited

U.S. PATENT DOCUMENTS

| | | | |
|---|---|---|---|
| 1,551,525 | 8/1925 | Hamer | 53/139.1 X |
| 2,810,996 | 10/1957 | Ranta | 53/71 |
| 3,339,915 | 9/1967 | Richard . | |
| 3,447,987 | 6/1969 | Williams . | |
| 3,534,520 | 10/1970 | Moran | 53/138.4 |
| 3,754,635 | 8/1973 | Mojden | 198/41 |
| 3,782,069 | 1/1974 | Fischbein et al. | 53/67 |
| 4,162,602 | 7/1979 | Achelpohl et al. | 53/139.1 X |
| 4,398,379 | 8/1983 | Burford | 53/77 |
| 4,490,960 | 1/1985 | Klemesrud | 53/135 |
| 4,539,002 | 9/1985 | Zak | 493/23 |
| 4,586,412 | 5/1986 | Johnson | 83/205 |
| 4,696,244 | 9/1987 | Sampson et al. | 112/262.1 |
| 4,747,813 | 5/1988 | Genoud et al. | 493/10 |

*Primary Examiner*—James F. Coan
*Attorney, Agent, or Firm*—Kinney & Lange

[57] ABSTRACT

A tin-tie bending device for bending the ends of a tin-tie about the edges of a bag wherein the tin-tie is secured to across the width of the bag and the ends of the tin-tie extend beyond the edges of the bag prior to bending. The device includes means for moving the bag along a travel path past a detecting means and a bending means of the device. The detecting means detects the bag as it travels past the detecting means. The bending means bends the end of the tin-tie about the edge of the bag and is actuated upon the detecting means sensing the passing of the bag along the bag travel path.

14 Claims, 13 Drawing Sheets 40
44
46
48
49A
49B
50
51
52
54
56
59
62
64
70
72
74
74A
74B
76
77
78
79
80
82
84
86
116
117
120
121
122
123
124
124A
124B
126
128
130
132
134
136
138
140
142
11
11A
22
23
23A
23B
25A
25B

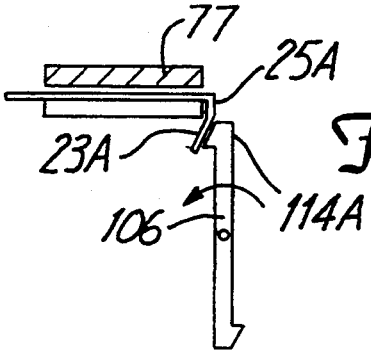
Fig. 12
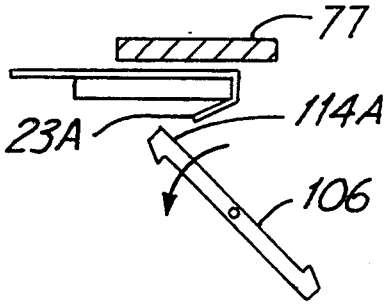
Fig. 13
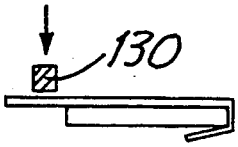
Fig. 14
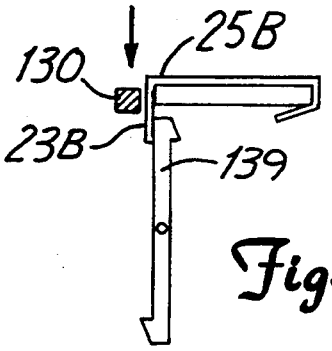
Fig. 15
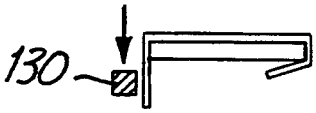
Fig. 16A
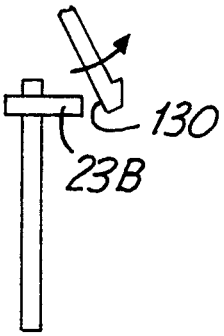
Fig. 16B
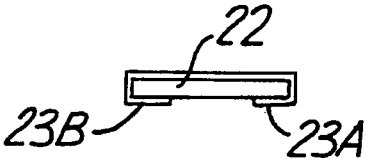
Fig. 17
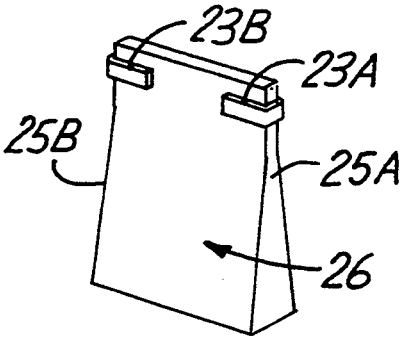

TIN-TIE BENDING MACHINE

RELATED CASE

The present application is a continuation-in-part application of co-pending U.S. application Ser. No. 08/122,107 filed on Sep. 16, 1993 for TIN-TIE CLIP BENDING DEVICE.

BACKGROUND OF THE INVENTION

The present invention relates to packaging containers. In particular, the present invention comprises an apparatus and method for bending a tin-tie type fastener about a multiple serving, reclosable, flexible packaging container.

A tin-tie fastener is typically secured across the width of a bag near the top of the bag at its open end. To close the container, the open top end of the bag is rolled down about the tin-tie and then the end portions of the tin-tie, which extends past the side edges of the bag, are folded about the edge of the bag to prevent the container's folded top from unrolling. An example of a tin-tie fastener acting as a closure is provided in U.S. Pat. No. 3,315,877.

Various devices have been proposed to apply a tin-tie fastener, i.e., secure the fastener, on the surface of a packaging container. One presently known device incorporates a tin-tie applicator as part of a total packaging sequence which can include the steps of constructing the packaging container, filling the container, applying a tin-tie closure to the container, folding over the open end of the container, and then manipulating the tin-tie closure to secure the container in its closed state. The presently known devices typically move the container along a conveyor wherein the bag stops at one or several stations to allow that particular function to be performed to the container. For example, in most devices, the bag is stationary while being filled. One known device includes a station for bending the ends of a tin-tie about the edges of a container while the container is stopped, i.e. stationary, along the conveyor. The presently known devices typically are inflexible in use, i.e., they can only be used with one size bag. These present devices also are slow and cannot process a substantial number of bags per minute because at least one of the stations require stopping motion of the bag.

Other known tin-tie bending devices include the device of the Klemesrud U.S. Pat. No. 4,490,960. The Klemesrud patent describes a device for sequentially bending the ends of a tin-tie strip, which project from the leading and trailing edges of a bag sidewall, around the edges of the bag top about 180° into snug engagement with an opposite bag sidewall as the bags are moved through the device by conveyor means.

SUMMARY OF THE INVENTION

The present invention comprises a tin-tie bending device for use with a packaging container having a tie-fastener secured thereon with the tie fastener having ends extending beyond the edges of the packaging container. The tie-bending device of the present invention bends the ends of the tie fastener relative to the edge of the packaging container. Although the present invention can be used with a variety of packaging containers, we will describe the present invention as using a bag having an upper open end.

The tin-tie bender of the present invention includes means for moving the bag along a travel path from a first end of the device to a second end of the device. The device further comprises a means for detecting the bag as the bag travels by the detecting means wherein the detecting means is disposed between the first and second ends of the device. A means is provided for bending a first end of the tin-tie at an angle relative to a first edge of the bag wherein the bending means is connected to the detecting means and is actuated to bend the first end of the tin-tie about the edge of the first bag upon the detecting means detecting the bag. The first bending means is spaced from the detecting means and disposed between the detecting means and the second end of the device along the bag travel path.

A further refinement of the present invention comprises providing a second means for detecting the bag as the bag travels past the second detecting means wherein the second detecting means is spaced from the first bending means and disposed between the first bending means and the second end of the device along the bag travel path. A second means for bending a second end of the tin-tie about a second edge of the bag is provided wherein the second bending means is connected to the second detecting means and is actuated to bend the second end of the tin-tie about the second edge of the bag upon the second detecting means detecting the bag. The second bending means is spaced from the second detecting means and is disposed between the second detecting means and the second end of the device along the bag travel path.

The first and second means for detecting can be a photoelectric sensor (or pair of sensors) which generates an electric signal upon an edge of the bag interrupting a light path adjacent the photoelectric sensor to ultimately cause actuation of the first bending means. Alternatively, the detecting means can be a mechanical sensor wherein physical contact between the bag and a portion of the sensor detects the passing of the bag. The first bending means can include a first clutch operably coupled with a rotating drive shaft wherein the first clutch is capable of producing a high speed single revolution of an axle extending from the clutch. The clutch is further coupled to, via the axle, a first paddle. The long axis of the first paddle is disposed perpendicularly (and vertically) relative to a horizontal or long axis of the clutch axle. The first paddle is disposed for transverse movement across the bag travel path to displace an end of the tin-tie relative to and about an edge of the bag as the bag passes by the first bending means.

The first bending means can additionally include a second clutch and a second paddle combination wherein the second paddle rotates horizontally with respect to the vertical plane of the bag to strike the first end of the tin-tie after the first end of the tin-tie has been displaced by the first paddle. The second paddle displaces the tin-tie horizontally toward a sidewall of the bag (about 60 degrees) after the first paddle has displaced the first end of the tin-tie about 90 degrees horizontally with respect to the vertical plane of the bag.

The second bending means can be a second clutch and second paddle combination similar to the first clutch and first paddle combination of the first bending means wherein the second paddle rotates transversely across the path of bag travel to strike the second end of the tin-tie to displace the second end of the tin-tie 90° horizontally with respect to the vertical plane of the bag about an edge of the bag.

The tin-tie device may further comprise a third means for bending the first and second end of the tin-tie, the third bending means being located between the second bending means and the second end of the device. The third bending means can be a stationary pair of plates on either side of the bag travel wherein the plate is tapered to force an end of the tin-tie, which is angularly displaced from the vertical plane of the bag, into further engagement or proximity with the sidewall of the bag.

A fourth means for bending the ends of the tin-tie comprises a pair of rollers disposed on opposite sides of the bag travel path and disposed between the third bending means and the second end of the device along the bag travel path. The rollers are biased against each other to exert pressure therebetween such that as the bag travels through the pair of rollers, the first and second ends of the tin-tie are firmly crimped against the sidewall of the bag. This completes the tin-tie bending process.

Another embodiment of the present invention includes a first bending means and a first detecting means as in the first embodiment. However, this embodiment of the tin-tie bending device does not include a second detecting means, a second bending means, and a third bending means as in the first embodiment. In addition, the second paddle of the first bending means comprises a two-prong forked paddle to operate in cooperation with the first paddle of the first bending means.

In this embodiment, the first bending means bends both the first end and the second end of the tin-tie. In particular, in this embodiment, the first paddle of the first bending means first bends the second end (e.g., leading end) of the tin-tie relative to the second edge (e.g., leading edge) of the bag (now partially bent about 90°). A first prong of the forked second paddle acts as an anvil to support the bag during bending of the leading end of the tin-tie. A second prong of the forked paddle (remaining stationary) bends the second end of the tin-tie another 90° about the leading edge of the bag as the leading edge of the bag travels past the second prong of the horizontal paddle.

Next, the first paddle of the first bending means rotates a second time to bend the first end (e.g., trailing end) of the tin-tie about 90° about the first edge (e.g., trailing edge) of the bag. The second prong of the forked second paddle acts as an anvil to support the bag during bending of the trailing end of the tin-tie. In addition, the second paddle, which rotates horizontally with respect to the vertical plane of the bag, then strikes the trailing end of the tin-tie with its first prong to further bend the trailing end of the tin-tie another 90° about the trailing edge of the bag.

This embodiment also includes a fourth bending means comprising a pair of tin-tie engaging belts disposed on opposite sides of the bag travel path. The tin-tie engaging belts travel in the same direction and at the same speed as the bag travels. The tin-tie engaging belts are biased against each other for at least a portion of their length to exert pressure therebetween to firmly crimp the first and second ends of the tin-tie against the sidewall of the bag. The pair of tin-tie engaging belts are preferred to the pair of crimp rollers (of the first embodiment) because the tin-tie engaging belts tend to maintain the fold lines of the ends of the tin-tie closer to the respective edges of the bag.

The device of the present invention has several desirable advantages. First, the device can handle changes in bag width without requiring a change in the speed of the conveyor to accommodate the changed bag size. This results from the speed and timing of the bending means being controllable (via a timing circuit and a microprocessor) independently of the speed and timing of the conveyor. The action of the bending means is triggered by the detecting means sensing the edge of the bag as it moves past the detecting means. Accordingly, the bag moves continuously along the conveyor during bending of the ties. Moreover, an alignment sensor insures alignment of the rotary arm (paddle) in the proper position for striking a tin-tie as a bag travels by the arm. There is a means for adjusting the distance from the edge of the bag to the location of fold line of the tin-tie ends. This adjustment results from the capability to select a delay between the sensing of the bag and the actuation of the bending means to strike the tin-tie. Moreover, one can adjust the location of the fold line for the trailing edge end of the tin-tie independent of the location of the fold line for the leading edge of the tin-tie end. In the first embodiment, this adjustment preference results from the first detecting and bending means being controllable (via the CPU) independently of the second detecting and bending means. In the second embodiment, this adjustment preference results from the first revolution of the first paddle being controllable (via the CPU) independently from the second revolution of the first paddle because each revolution is triggered by a different signal from the detecting means.

The present device is also operable as a module separate from the other handling steps of trimming the bag, folding the bag, and applying the tin-tie to the bag. The present invention also includes a magnetic block for holding the tin-tie as the tin-tie moves there along. This insures stabilization of the bag in a generally vertical plane relative to the bag.

BRIEF DESCRIPTION OF THE DRAWINGS

FIGS. 8–17 are schematic representations illustrating a sequence of steps in bending ends of a tin-tie by the tie bending device of the present invention.

DETAILED DESCRIPTION OF THE PREFERRED EMBODIMENTS

Throughout the specification of the application, various terms are used such as "left", "right", "inward", "outward", and the like. These terms denote directions with respect to the drawings and are not limitations of orientation of the present invention. Rather, these terms are provided for clarity in describing the relationship between components of the tin-tie bending device, and between the bag and the tin-tie bending device.

Figure 1:
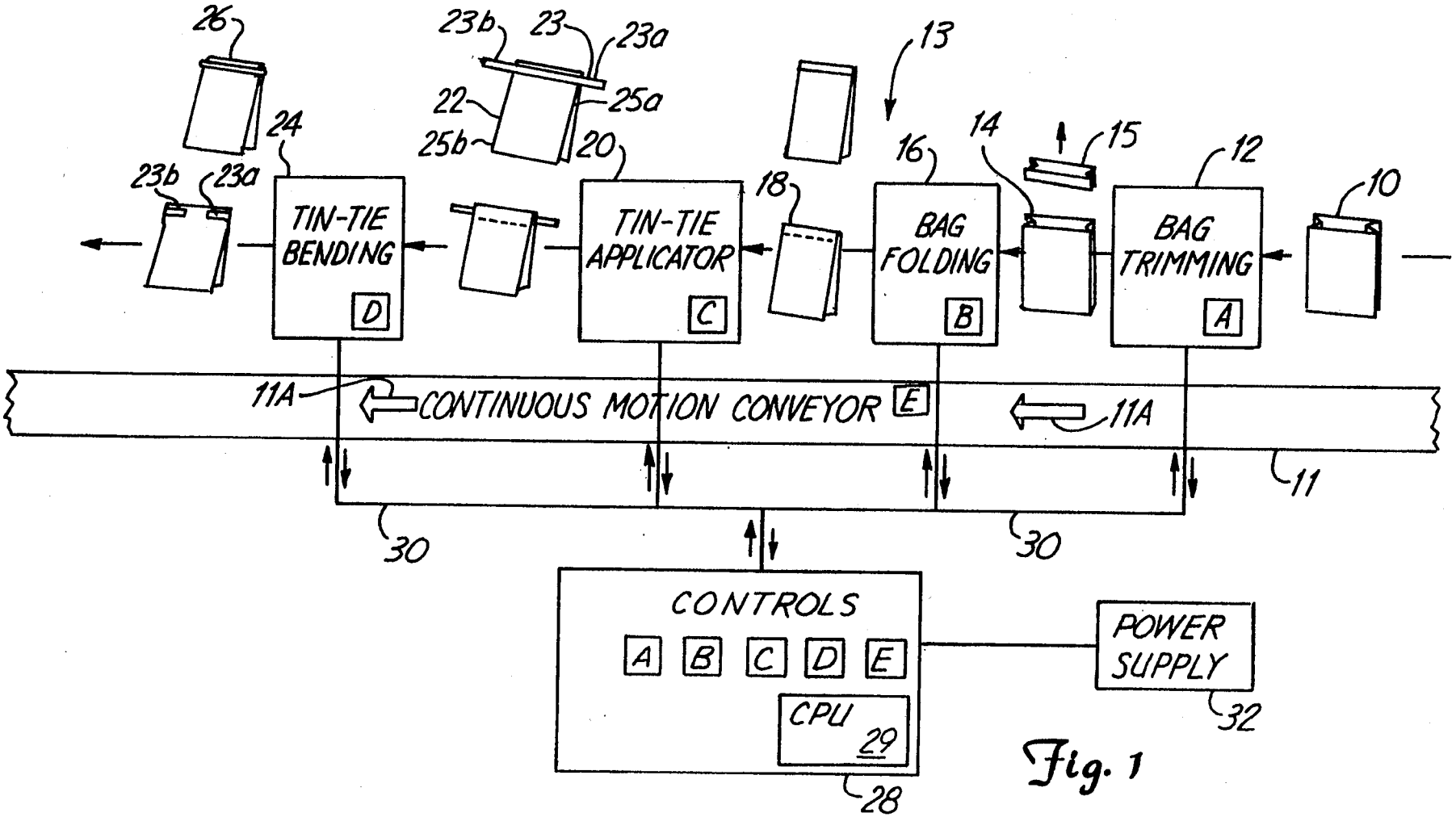
FIG. 1 is a schematic view showing a tin-tie bending device of the present invention incorporated into an overall bag processing device.

A tin-tie bending device of the present invention is typically part of a larger device for manipulating a bag 10 from a beginning state having an open end to a final state in which the open end of the bag has been trimmed, folded over, and securely closed with a tin-tie fastener. FIG. 1 schematically depicts four modules of an overall bag processing device. The device includes four main stations: (1) a first station 12 for trimming the bag to remove any excess material from the top of the bag; (2) a second station 16 for folding over the top portion of the bag; (3) a third station 20 for applying the tin-tie fastener 23 across the folded over top portion of the bag; and (4) a fourth station 24 for bending the ends of the tin-tie fastener about the edges of the folded over top portion of the bag to secure the bag in its closed state.

As seen in FIG. 1, a bag 10, either empty or filled, is moved along the whole length of the device 13 by a conveyor 11 through each of the respective stations 12, 16, 20 and 24. The bag 10 moves sequentially through each station beginning with the bag trimming station 12 which removes any excess material 15 from the top portion of the bag 10, resulting in a trimmed bag 14 appropriately sized for the remaining stations of the bag assembly device 13. This bag trimming section 12 allows for bags of varying height to be fed into the device 13 wherein the bag trimming section 12 normalizes the bag height by removing any excess portion of the bag near its top. The bag trimming section 12 typically includes a pair of rotary trimming discs, disposed on the opposite sides of the bag to shear the top portion of each bag to the correct height for proper folding.

Next, the trimmed bag 14 enters the bag folding station 16 wherein the top portion of the bag is folded over once and then a strip of glue is applied across the width of the bag against the bag sidewall and the once-folded over top portion of the bag is folded again so that the folded over section is pressed against the strip of glue on the sidewall of the bag. This results in the top portion of the bag having been folded over twice and being retained in that position by the adhesive glue strip between the folded over segment of the bag and the bag sidewall.

Next, the folded over bag 18 enters the tin-tie applicator section 20 of the device 13 so that a tin-tie fastener 23 can be adhesively applied across the width of the bag along the folded over portion of the bag 18. The tin-tie preferably has a pair of metallic ribs embedded within plastic or paper and extending the length of the fastener. The tin-tie applicator section 20 used with the tin-tie bending device of the present invention is that disclosed in Applicant's co-pending U.S. application Ser. No. 08/034,350 filed Mar. 19, 1993, titled APPARATUS AND METHOD OF APPLYING A TIN-TIE. After the bag is processed by the tin-tie applicator section 20, the tin-tie and bag combination 22 is directed along the conveyor 11 to the tin-tie bending section 24.

It is the tin-tie bending section 24 of the device 13 which is the focus of this patent application. The tin-tie bending section 24 manipulates the bag 22 (having the tin-tie applied thereon) into a finished bag 26 wherein the ends 23A and 23B of the tin-tie have been folded about the edges 25A and 25B of the bag and into secure engagement with the sidewall of the bag to complete secure closure of the previously open ended bag 14.

Controls 28 are provided for the activation and adjustment of the various sections 12, 16, 20 and 24, as well as the conveyor 11, of the device 13. The controls 28 include a microprocessor 29 connected to the various sections by control leads 30 which allows both sending and receiving of signals between the controls and the various sections. The controls 28 and device 13 are connected to a power supply 32.

Figure 2:
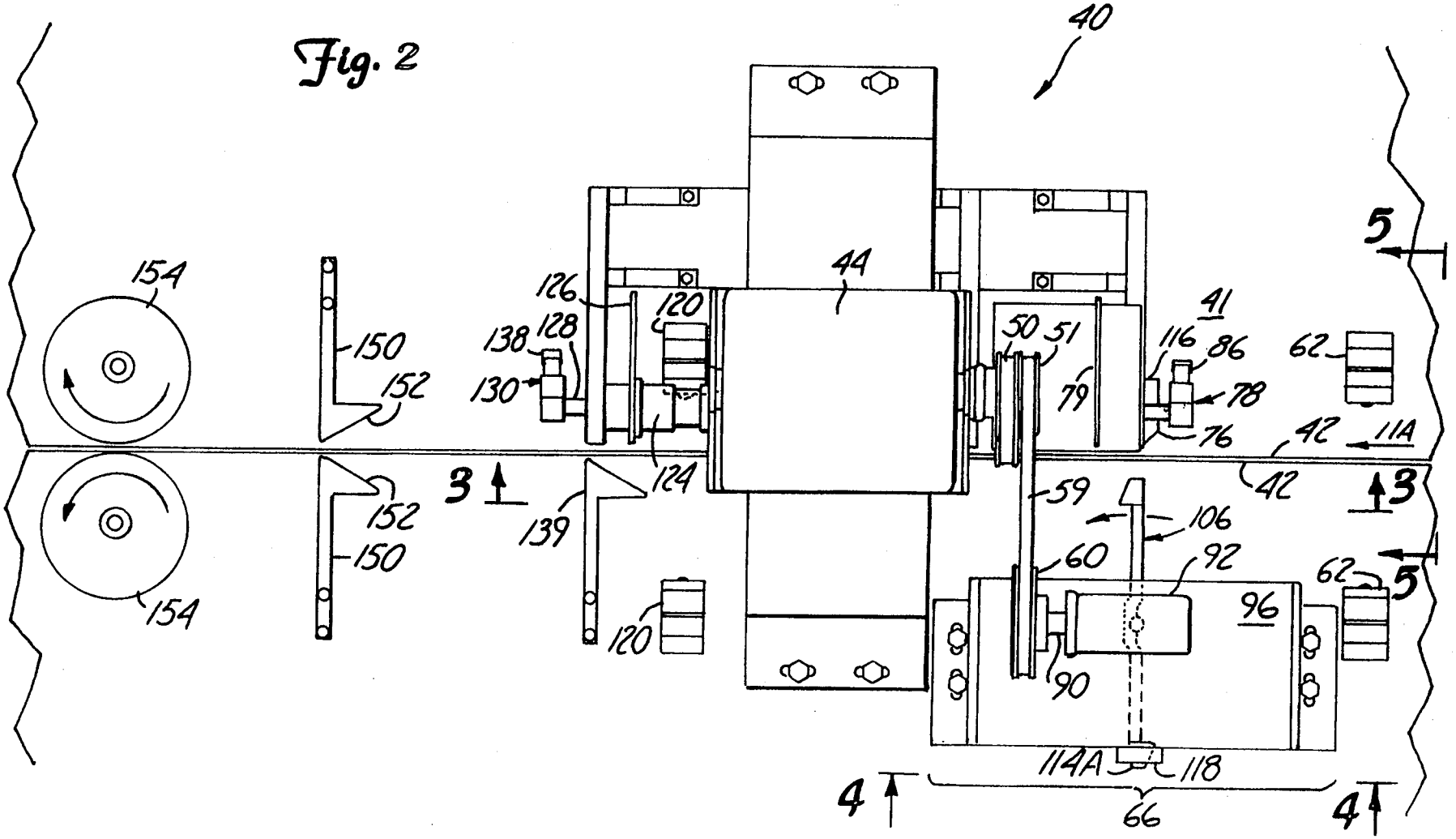
FIG. 2 is a plan view of the tin-tie bending device of the present invention.
Figure 3:
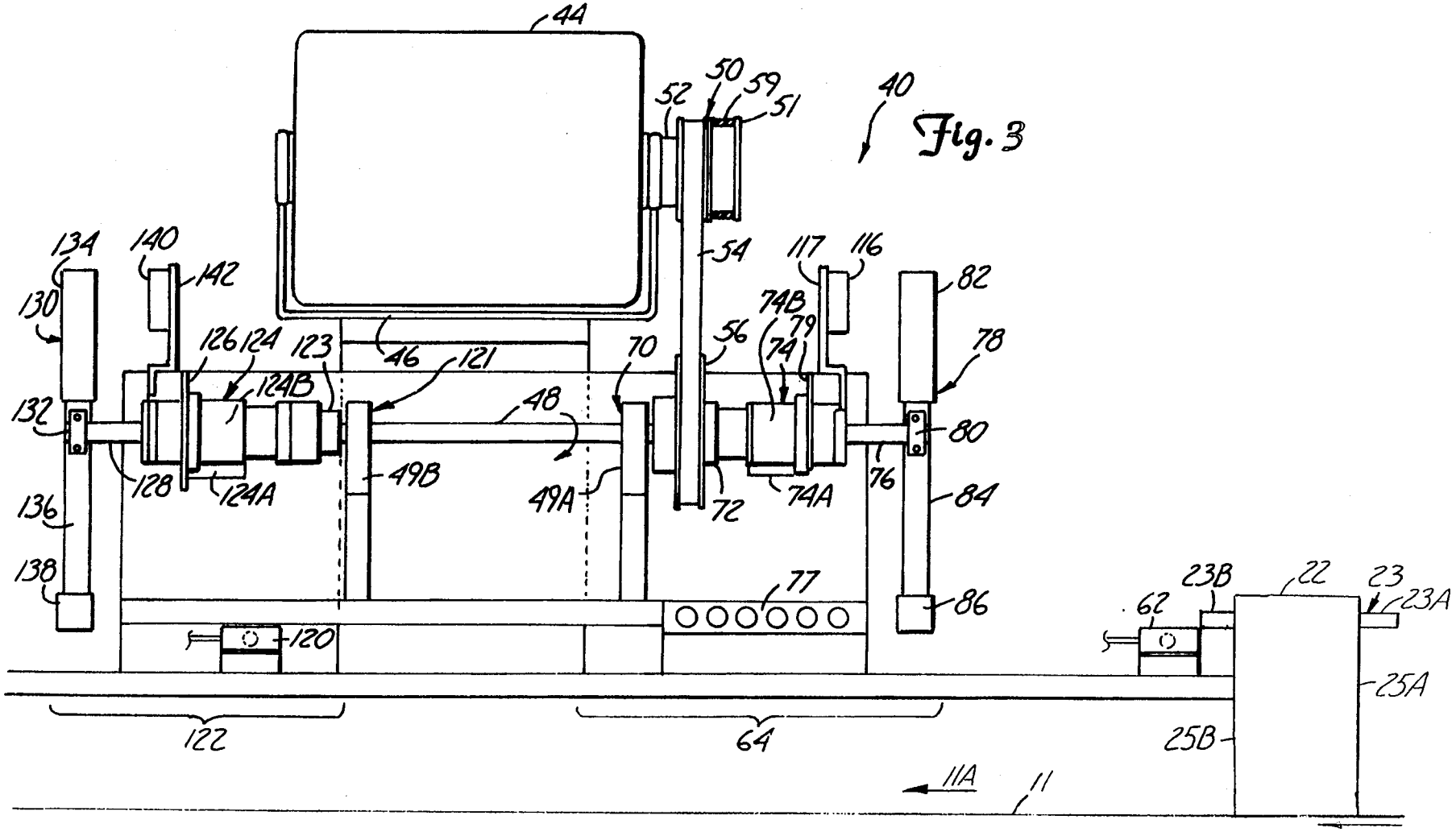
FIG. 3 is a front view in elevation of the tin-tie bending device taken along line 3—3 of FIG. 2.
Figure 4:
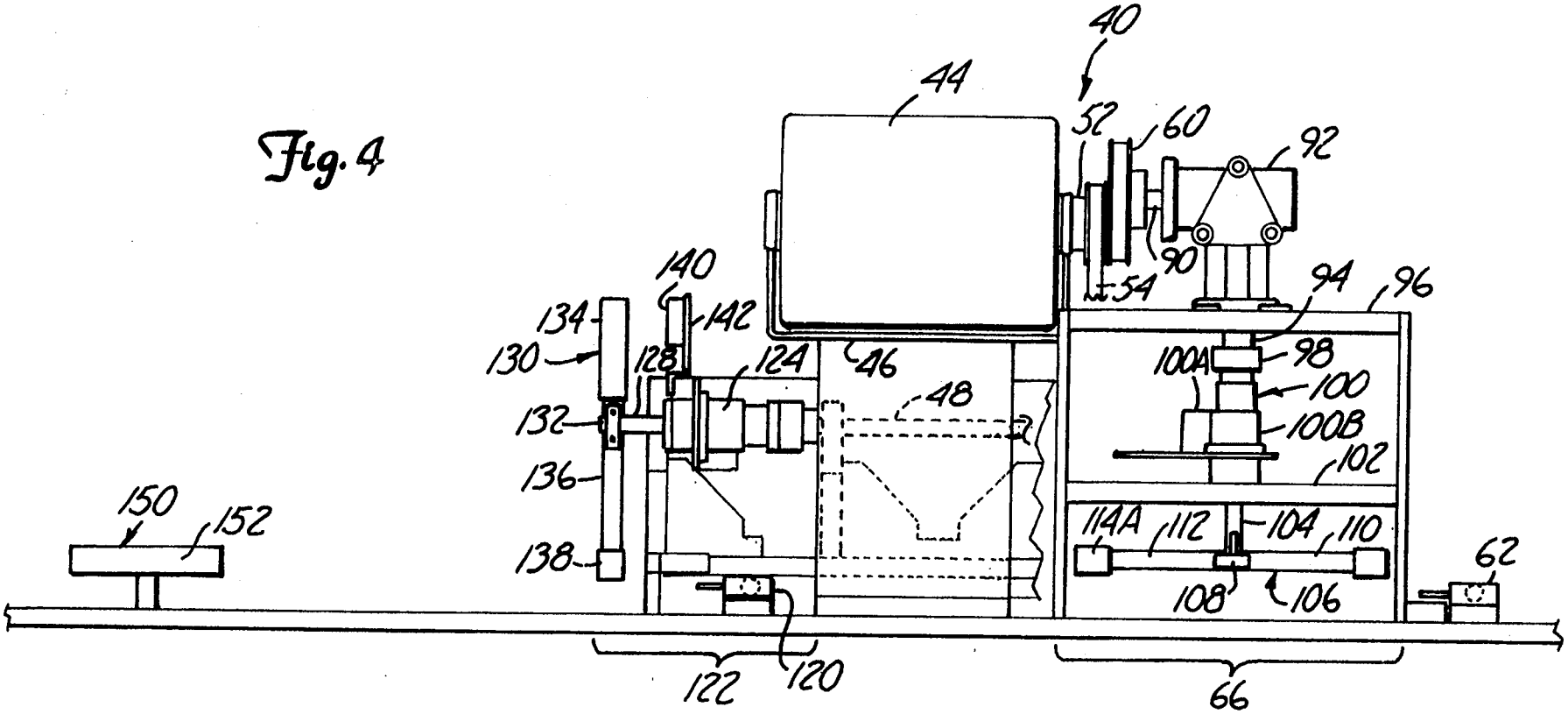
FIG. 4 is a front view in elevation of the tin-tie bending device taking along line 4–4 of FIG. 2.

The tin-tie bending device of the present invention (shown schematically as 24 in FIG. 1) is shown in FIGS. 2, 3 and 4 generally at 40. As seen in FIG. 2, the tin-tie device 40 is supported by a frame 41 and includes a means for moving the bag along a travel path (arrows 11A) from a first end of the device to a second end of the device. The moving means preferably comprises a pair of opposed drive belts 42 of the overall packaging device, which grip the bag 22 and move the bag 22 from right to left as shown in FIG. 1 (arrows 11A). The drive belts 42 hold the bag 22 upright while it is being supported by the conveyor 11, which also moves right to left as shown in FIG. 3. The conveyor 11 and guide belts 42 move the bag 22 from the tin-tie applicator section 20 into and through the tin-tie bender section 40 (schematically depicted as 24 in FIG. 1).

As best seen in FIG. 3, the tie bender device 40, with the exception of the conveyor 11 and guide belts 42, is powered by an electric motor 44. As seen in FIG. 3, the motor 44 is mounted on a frame 46 above a main line shaft 48. A pulley 50 is mounted on a shaft 52 of the motor 44 and drives a belt 54 coupled to a pulley 56 on the line shaft 48, imparting rotational motion to the line shaft 48. As seen in FIG. 3, the motor shaft 52 also drives a pulley 51, thereby driving a belt 59 and imparting rotational motion to a pulley 60 (FIG. 4). The electric motor 44 is independent of a motor driving the conveyor 11 and guide belts 42. This allows the speed and timing of bending device 40 to be operated independent of the speed of the conveyor.

A first detecting means of the present invention is provided for detecting the bag 22 as the bag 22 travels past the first detecting means on the conveyor 11. As seen in FIG. 2 and 3, the first detecting means can be a pair of photoelectric sensors 62 which are disposed on opposite sides of the drive belts 42 (see FIG. 2) and above the surface of the drive belts 42 (FIG. 3) to detect the presence of a bag 22 moving along the travel path 11A between the sensors 62. The sensors 62 are electrically connected to the controls 28 including the microprocessor 29 (shown as CPU in FIG. 6) and preferably are used for detecting a trailing edge 25A of the bag as the bag 22 moves along the bag travel path 11A on conveyor 11.

The tin-tie bender station 40 also comprises a first means for bending a trailing end 23A of a tin-tie at an angle relative to the first edge 25A of the bag. The first bending means preferably comprises a first vertical tab bender portion 64 and a horizontal tab bender section 66. The first vertical tab bender section 64 is defined as that portion of the station 40 to the right of the frame member 49A as seen in FIG. 3, As seen in FIG. 2, the horizontal tab bender section 66 is disposed on a side of the bag travel path 11A opposite the first vertical tab bender 64.

Figure 7:
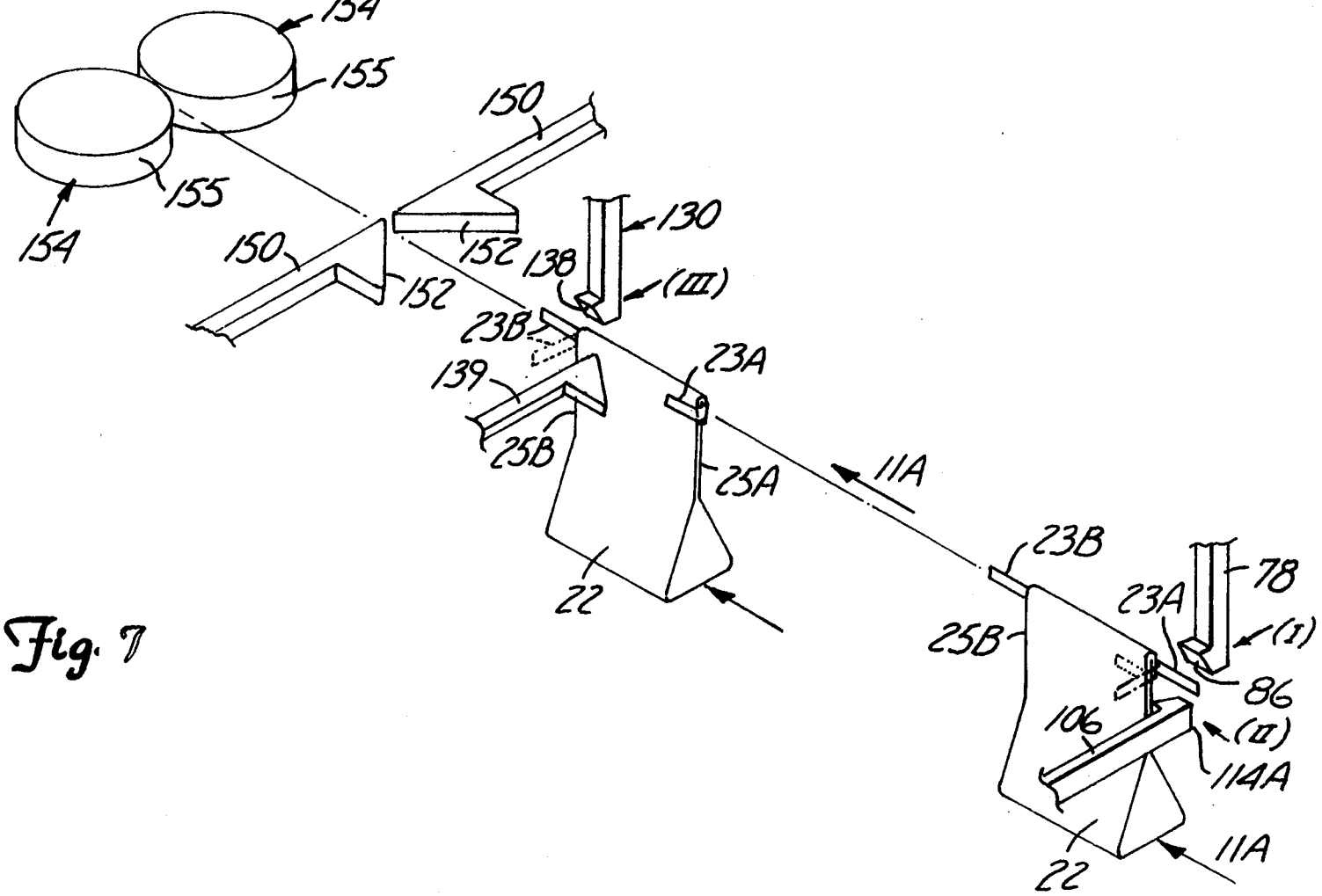
FIG. 7 is a schematic view illustrating several steps in the manipulation of a bag with a tin-tie secured thereon by the tin-tie bending device present invention.

The first vertical tab bender section 64, as seen from left to right in FIG. 3, includes the frame member 49A through which the main line shaft 48 extends via a bearing member 70 incorporated into the frame 49A. The drive pulley 56 carrying the belt 54 is connected to the line shaft 48. A hub 72 connects a clutch actuator assembly 74 to the drive pulley 56 and line shaft 48. The clutch actuator assembly 74 includes a solenoid 74A and a wrap spring single revolution clutch 74B. The clutch assembly 74 is connected to another plate 79 for suspending the clutch assembly 74 from the main frame 49A. An axle 76 extends from the clutch assembly 74 and has a paddle 78 mounted thereon at its end by a suitable fastener means 80. The paddle 78 includes a rear portion 82 and a forward portion 84 having a contact head 86. The paddle 78 rotates about a horizontal axis (the longitudinal axis of the axle 76) parallel to the bag travel path 11A so that the paddle 78 sweeps a path transversely in a direction across the bag travel path 11A (see arrow (I) in FIG. 7). The forward portion 84 of the paddle 78 extends from the axle 76 for a sufficient length so that contact head 86 is at the same level as the ends 23A and 23B of a tin-tie 23 on a bag 22 traveling by the paddle 78. A magnetic head section 77 is disposed to the left of the paddle 78 and is comprised of several magnets for attracting the metallic component of the tin-tie 23 and holding the tin-tie 23 against the section 77 as the tin-tie 23 travels by the magnetic section 77 along the bag travel path. This results in the magnetic section 77 maintaining the upper portion of the bag 22 (that portion extending above the guide belts 42) in a generally vertical plane.

The horizontal tab bender section 66 is powered via the belt 59 (driven by the drive pulley 51) which drives the pulley 60 of the horizontal tab bender section 66. A shaft 90 extends from the drive pulley 60 into a right angle gear box 92 translating rotational motion of the shaft 90 to rotational motion of a shaft 94 (FIG. 4). The right angle gear box 92 is supported by a frame 96. A hub 98 connects a clutch assembly 100 to the drive shaft 94. The clutch assembly 100 includes a solenoid 100A and a wrap spring single revolution clutch 100B. The clutch assembly 100 is further supported by a plate 102 through which an axle 104, connected to the clutch assembly 100, extends. A paddle 106 is connected at an end of the axle 104 by a suitable fastener means 108. The paddle 106 includes a rear portion 110 and a forward portion 112 having a contact head 114A. The paddle 106 rotates about a vertical axis (about the longitudinal axis of the axle 104) perpendicular to the bag travel path so that the paddle 106 sweeps a path in a direction adjacent the bag travel path. (See arrow (II) in FIG. 7). The paddle 106 is of a length such that the contact head 114A will pass closely adjacent the bag 22 along the travel path 11A.

Figure 5:
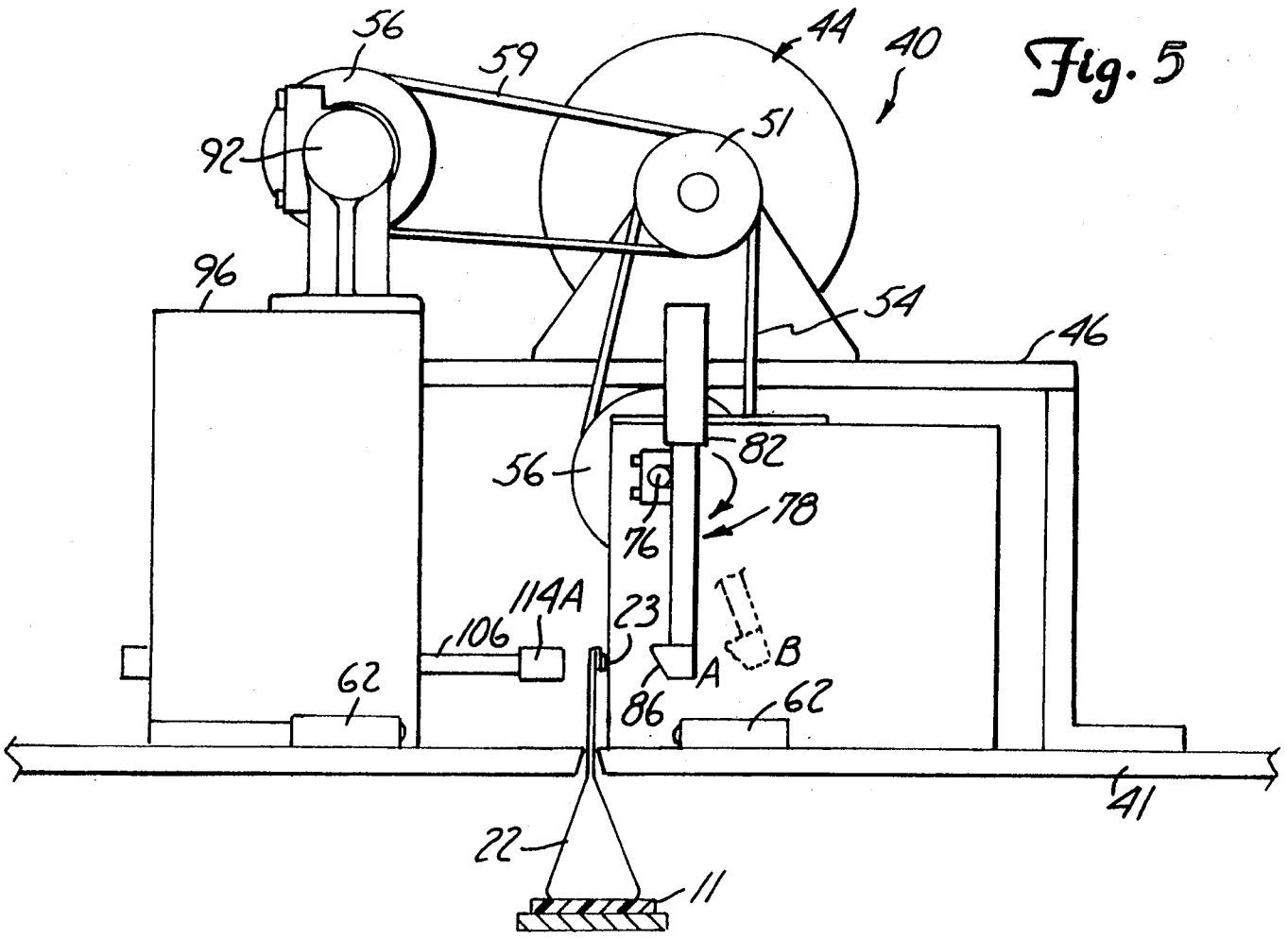
FIG. 5 is a side view in elevation of the tin-tie bending device as taken along line 5—5 in FIG. 3.

Each of the clutch assemblies 74 and 100 of the vertical bending section 64 and the horizontal bending section 66, respectively, include the combination of a wrap spring single revolution clutch and a solenoid. For example, the solenoid 74A of the clutch assembly 74 of the first vertical tab bender portion 64 is electrically connected to the sensors 62 via the controls 28. Upon triggering of the sensors 62 (by the bag breaking the beam of light between the sensors 62) a signal is directed into the microprocessor 29 of the controls 28 and then transmitted to solenoid 74A. This energizes the solenoid 74A, causing the wrap spring clutch 74B to engage the constantly rotating main line shaft 48 for one revolution, resulting in the single 360° revolution of axle 76. This revolution of axle 76 causes the paddle 78 and in particular, its contact head 86 to leave its starting position near magnetic head 77 and travel a 360° clockwise (as seen from the side view of FIG. 5) path relative to and about the axle 76 and return to its position adjacent the magnetic head 77.

Similarly, the horizontal tab bender section 66 becomes active upon a signal from the sensor 62 that energizes the solenoid 100A (via CPU 29), causing the wrap spring clutch 100B to engage the main line shaft 48 for one revolution causing a single 360° rotation of axle 104. This causes paddle 106 to complete a 360° revolution beginning in the position as shown in FIG. 2 in a counterclockwise direction as seen from FIG. 2 wherein the contact head 114A begins travel of a 360° path and wherein the cycle of operation is completed when the contact head 114A returns to its position adjacent the sensor 118.

The wrap spring clutch 74B and 100B are of the type causing nearly instantaneous acceleration of the contact head to spin at an rpm of 1200 for only one revolution, whereupon the contact head 86 stops abruptly once it has returned to its starting position. The clutch assembly comprising the solenoid and wrap spring single revolution clutch can be obtained from the Warner Electric Co. of Beloit, Wis.

The microprocessor 29 of the controls 28 can be programmed for introducing a desired amount of delay between the sensing of an edge portion of the bag (25A) and the actuation of the wrap spring clutch which causes the paddle 78 and then the paddle 106 to contact the tin-tie 23. By changing or adjusting this delay factor between the sensing of the edge of the bag and the movement of the respective paddle 78 and paddle 106, the distance between the edge of the bag and the fold line of the tin-tie projection (23A) can be controlled so that the point of folding can be either closer to the edge of the bag or farther away from the edge of the bag, as desired. A mechanical thumbwheel switch (not shown) is provided on controls 28 to adjust this delay factor (via the microprocessor 29). Moreover, the microprocessor of controls 28 can be used to control the predetermined delay between the actuation of the clutch assembly 74 and actuation of the clutch assembly 100 upon a signal from the sensors 62.

The first vertical tab bender 64 also includes a sensor 116 supported by a frame member 117 for insuring proper rotational alignment of the paddle 78 at startup before a first cycle of operation of the first vertical tab bender section 64. Similarly, a sensor 118 is connected to a frame 102 wherein the sensor 118 is provided for detecting alignment of the rear portion of the paddle 106 at startup before a cycle of operation of the horizontal tab bender section 66. For example, if the rear portion 82 of paddle 78 is not in vertical alignment with the photoelectric eye of sensor 116, the sensor 86 sends a signal to the CPU 29 of controls 28. The CPU then sends a signal to energize the solenoid 74B to actuate the clutch 74A causing rotation of the axle 76 until the rear portion 82 of the paddle 78 is in alignment with sensor 116. This insures proper positioning of the contact head 86 at startup before a first cycle of operation of the first vertical tab bender 64.

Figure 6:
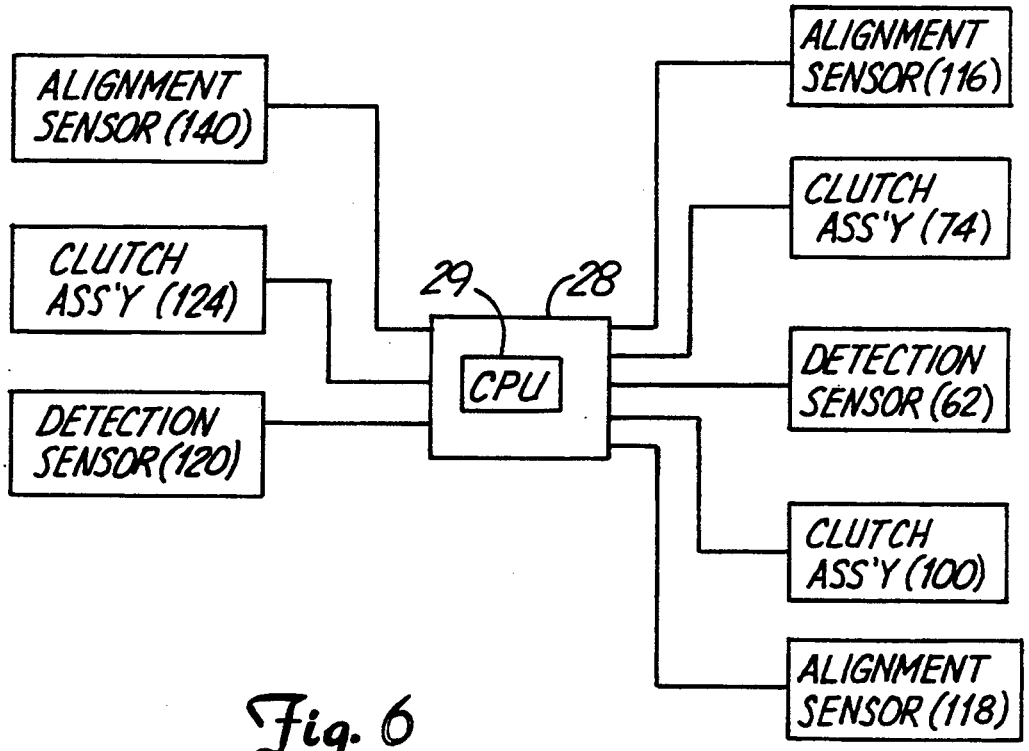
FIG. 6 is a schematic view illustrating an arrangement between a microprocessor and electrically operative components of tin-tie bending device.

A second detecting means is disposed between the first bending means and the second end of the device for detecting the bag 22 as the bag 22 travels past the second detecting means. The second detecting means can be a pair of sensors 120, similar to the photoelectric sensors 62. The sensors 120 as seen in FIG. 2, are disposed on opposite sides of the bag travel path 11A for detecting passage of the leading edge 25B of the bag 22 as it travels past the sensors 120. The sensors 120 are electrically connected to the controls 28 and to a clutch assembly 124 as shown in FIG. 6 and similar to the first tab bender section 64.

The first detecting means and second detecting means can also comprise a mechanical sensor instead of a photoelectric sensor wherein the bag is sensed by the bag making physical contact with the mechanical sensor located adjacent the bag travel path. The mechanical sensor then sends a signal to actuate the respective clutch assembly.

A second bending means is provided on the bag travel path 11 past the first bending means. The second bending means is preferably a second vertical tab bender section 122 similar to the first vertical tab bender section 64. As seen in FIGS. 2 and 4, the second vertical tab bender section 122 is defined as that portion of the device to the left of the frame member 49B. The line shaft 48 extends through a bearing member 121 incorporated into the frame member 49B. A hub 123 connects the clutch assembly 124 with the line shaft 48. The clutch assembly 124 includes a solenoid 124A and a wrap spring single revolution clutch 124B, and is connected to a plate 126 for supporting the clutch assembly 124 as it extends out from the line shaft 48. A rotation axle 128 extends from the clutch assembly 124 wherein a paddle 130 is connected at an end of the axle 128 by a fastener 132. The paddle 130 includes a rear portion 134 and a forward portion 136 having a contact head 138. The paddle 130 rotates about a horizontal axis (the longitudinal axis of the axle 128) parallel to the bag travel path so that the paddle 130 will sweep a path transversely in a direction (see arrows (III) in FIG. 7) across the bag travel path. The contact head 138 extends at a length from the axle 128 such that the contact head 138 is in alignment for contact with a leading edge tab 23B of the tin-tie 23 of the bag 22. A sensor 140 is provided on frame 142 for detecting alignment of the rear portion 134 of the paddle 130 to insure proper alignment at startup. As for the first bending means, the microprocessor 29 can provide and adjust a delay factor between sensing the edge 25B of the bag 22 and the movement of the paddle 130 to control the point of folding of the tin-tie end 23B relative to the edge 25B of the bag 22. The thumbwheel switch on the controls 28 allows adjusting the delay.

A third bending means for bending the ends of the tin-tie relative to the bag is disposed between the second bending means and the second end of the device. The third bending means can include a pair of stationary arms 150 disposed on opposite sides of the bag travel path 11A for further deflecting the ends of the tin-tie, 23A and 23B, against the sidewall of the bag 22. This pair of arms 150 uses a pair of ramped surfaces 152 for causing such deflection.

A fourth bending means for bending the ends of the tin-tie relative to the bag is disposed between the third bending means and the second end of the device along the bag travel path 11A. As seen in FIGS. 2 and 3, the fourth bending means can include a pair of crimp rollers 154 disposed on opposite sides of the bag travel path and biased toward each other such that a bag 22 passing therethrough will have a surface 155 of the rollers 154 press the ends 23A and 23B of the tin-tie into secure flush engagement with the sidewall of the bag 22. This affects final closure and crimping down of the tin-tie about the folded over top portion of the bag 22. The crimp rollers 154 are coupled mechanically by a pair of gears atop the rollers, the gears being powered by a motor powering the conveyor.

Figure 8A:
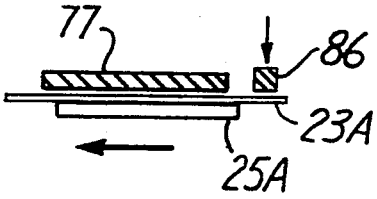
Figure 8B:
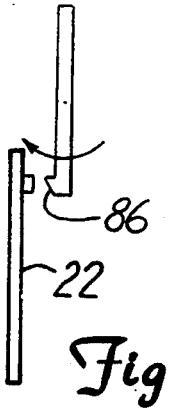
Figure 9A:
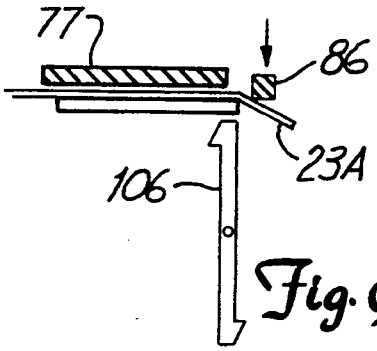
Figure 9B:
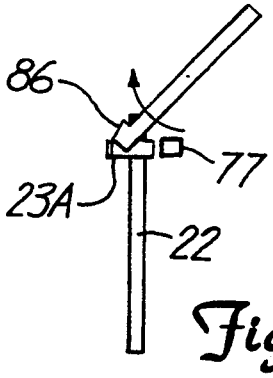

In use, the bag 22 enters the tie bender section 40 after having the tin-tie 23 applied along the top end of the bag 22 and secured thereon adhesively (with its ends 23A and 23B extending beyond the sides of the bag as seen in FIG. 3). As the bag 22 enters the tie bender section 40 along the conveyor 11 and through guide belts 42, the bag 22 passes through the pair of sensors 62, breaking the beam of light passing therebetween. The bag 22 continues to move to the left along the conveyor 11 as seen in the FIGS. Upon the trailing edge 25A of the bag 22 passing the sensors 62, the beam of light between the sensors 62 is again reestablished, thus sending a signal to the solenoid 74A of clutch assembly 74 via the controls 28. In addition, a signal from the controls 28, although with a slight time delay behind that of the signal sent to the first vertical bender section 64, is sent to the horizontal tab bender section 66, and in particular its solenoid 100A of clutch assembly 100. A timing circuit is built into the controls 28, which can be controlled by the microprocessor, such that the solenoid 74A will actuate the wrap spring clutch 74B to initiate rotation of the paddle 78 so that the paddle contact head 86 will begin its revolution just as the trailing tin-tie end 23A is moving in front of the contact head 86. (See FIG. 8A (top view) and FIG. 8B (end view)). Simultaneously, the magnetic section block 77 pulls the tin-tie 23 and bag firmly against the magnetic block 77 as the contact head 86 moves through the tin-tie end 23A to angularly displace it. (See FIG. 9A (top view) and FIG. 9B (end view)). The magnetic section block 77 serves as a stabilizing reference point maintaining the upper portion of the bag 22 in a generally vertical plane to accentuate the bending of tin-tie end 23A about the edge 25A of the bag 22. While the contact head 86 of paddle 78 begins its clockwise revolution to bend tin-tie end 23A, paddle 106 of the horizontal tab bending section 66 remains stationary, acting as a further anvil or reference against which the tin-tie end 23A may be bent, thus further facilitating the displacement of the tin-tie tab end 23A at a 90° angle relative to the vertical plane of the bag 22. (See FIG. 10A (top view) and FIG. 10B (end view)).

Figure 10A:
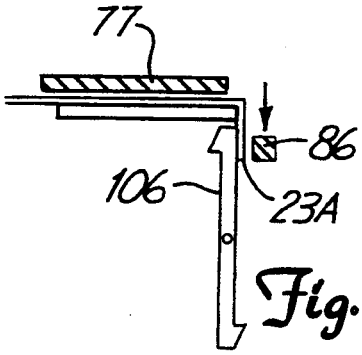
Figure 10B:
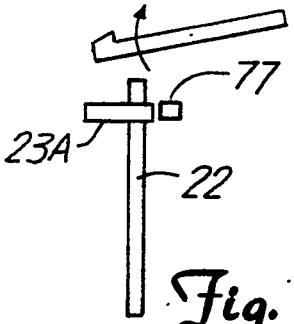
Figure 11A:
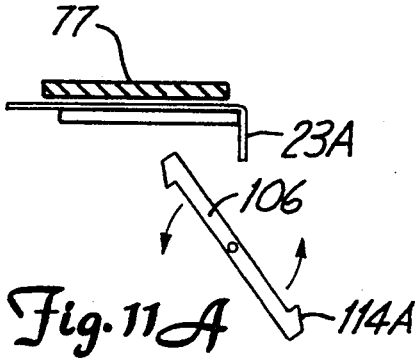
Figure 11B:
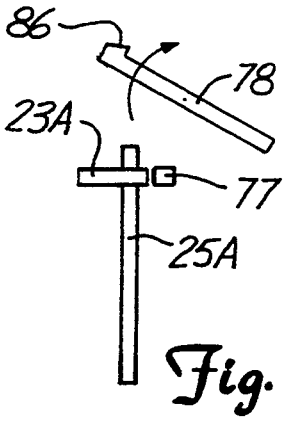

Immediately after the contact head 86 of the first vertical bender section 64 moves through and displaces the tin-tie end 23A to its 90° orientation as shown in FIG. 10A, the clutch assembly 100 for the horizontal tab bending section 66 is actuated after a predetermined time delay from the actuation of clutch assembly 74, thereby allowing the contact head 86 to be out of the path of travel of paddle 106 of the horizontal tab bending section 66. (See FIG. 11A (top view) and 11B (end view)). Actuation of the clutch assembly 100 causes nearly instantaneous acceleration of the paddle head 114A which begins its 360° revolution by action of the wrap spring single revolution clutch 100B and as seen in FIG. 12 upon traveling 180°, strikes the now partially bent (about 90°) tin-tie end 23A to further displace and bend the tin-tie end 23A about the trailing edge 25A of the bag 22 until in the position shown in FIG. 13, wherein the tin-tie end 23A is substantially bent about the edge 25A of the bag. As for the first vertical tab bending operation, the magnetic section 77 holds the upper portion of the bag 22 upright during the action of the paddle 106. After striking the tin-tie end 23A, the contact head 114A of the paddle 106 continues its revolution until it completes a path of a 360° revolution whereupon the paddle contact head 114A comes to a complete stop at sensor 118.

As the respective paddles 78 and 106, in sequence, bend the tin-tie end 23A, the bag 22 is being moved continuously, i.e., without stopping, along conveyor 11 and through guide belts 42. Manipulation of the tin-tie end 23A in this fashion is possible because of the extremely high rotation speed of the respective paddles 78 and 106 caused by the wrap spring clutches 74 and 100, respectively. Accordingly, the bag 22 need not be stopped along its path on the conveyor 11 for this bending action to take place. The magnetic head section 77 does not stop the bag 22 but merely draws the bag against itself to provide a stable reference point to accentuate bending of the tin-tie ends 23A as the bag moves past this portion of the first vertical tab bender 64 and the horizontal tab bending section 66. The magnetic section 77 is particularly advantageous because it firmly holds the bag 22 without interfering with the horizontal sweep of the paddle 106 or the vertical sweep of the paddle 78.

Next, with the bag still moving at its constant, uninterrupted speed along the conveyor 11, the leading edge 25B of the bag 22 breaks the light beam extending between the pair of sensors 120 located in the second vertical tab bender section 122. This energizes the solenoid 124A (via controls 28) of the clutch assembly 124, thereby actuating the wrap spring single revolution clutch 124B and causing rotation of the paddle 130. A predetermined delay between the signal from the sensors 120 and the activation of the clutch 124 causes the contact head 138 of paddle 130 to begin its near instantaneous acceleration into contact with tin-tie end 23B just as the leading edge 25B of the bag 22 is immediately adjacent to the contact head 138 (See FIG. 14). The movement of the contact head 118 through the tin-tie end 23B (see FIG. 15) results in the 90° angular displacement of the tin-tie end 23B as shown in FIG. 16A. A stationary arm 139 positioned on an opposite side of the guide belts 42 from the clutch assembly 124 provides another stable reference point against which the tin-tie 23B can be bent as the contact head 138 displaces or drives the tin-tie end 23B toward the viewer (FIG. 15). The arm 139 maintains the upper portion of the bag 22 in a generally vertical plane while the paddle 130 bends the tin-tie end 23B about the edge of the bag 22. The contact head 138 continues moving through a full 360° revolution (see FIG. 16B (end view)) before stopping at its original starting position. The rear portion 134 stops in alignment with sensor 140 to insure readiness of the paddle 130 for bending the next tin-tie of the next bag 22.

The high speed clutch mechanisms 74, 100 and 124 insure that the tab bending section 40 can operate at a high enough speed to adapt or account for a high bag speed, such as 80 bags per minute, along the conveyor 11. Moreover, because the tab bender section 40 is powered independently of the conveyor 11, one need not be concerned with carefully adjusting timing of the conveyor with the speed of rotation of the paddles. Rather, movement of the paddles 78, 106 and 130 are driven independently by their own motor 44 and their movement is controlled independently of the conveyor 11. In particular, movement of the paddles 78, 106 and 130 are initiated and controlled by the activation of the pair of sensors 62 and 120 (via controls 28) which detect, respectively, the trailing edges and leading edges of a bag passing through the tab bender section.

After the second vertical tab bender section 122 displaces the tin-tie end 23B by 90° (FIG. 16A), the bag, still moving continuously along conveyor 11, next approaches the ramped surfaces 152 of the stationary displacement arms 150 (disposed on the opposite sides of the bag travel path), which further displace the tin-tie ends 23A and 23B toward the surface of the bag sidewall (See FIG. 2). After passing through the stationary displacement arms 150, the bag 22 continues its path along the conveyor 11 and into the pair of crimp rolls 154 which are biased toward each other so that pressure is exerted between their outer surfaces 155. Thus, as the tin-tie bag 22 moves through the crimp rolls 154, the surface 155 of the crimp rollers 154 presses the ends 23B and 23A of the tin-tie into flush engagement with the surface of the bag sidewall. This results in the bag 22 and tin-tie 23 having the shape shown in FIG. 17. This completes the tin-tie bending process resulting in a bag 26 having a secure closure for a folded over top portion of the bag.

Figure 18:
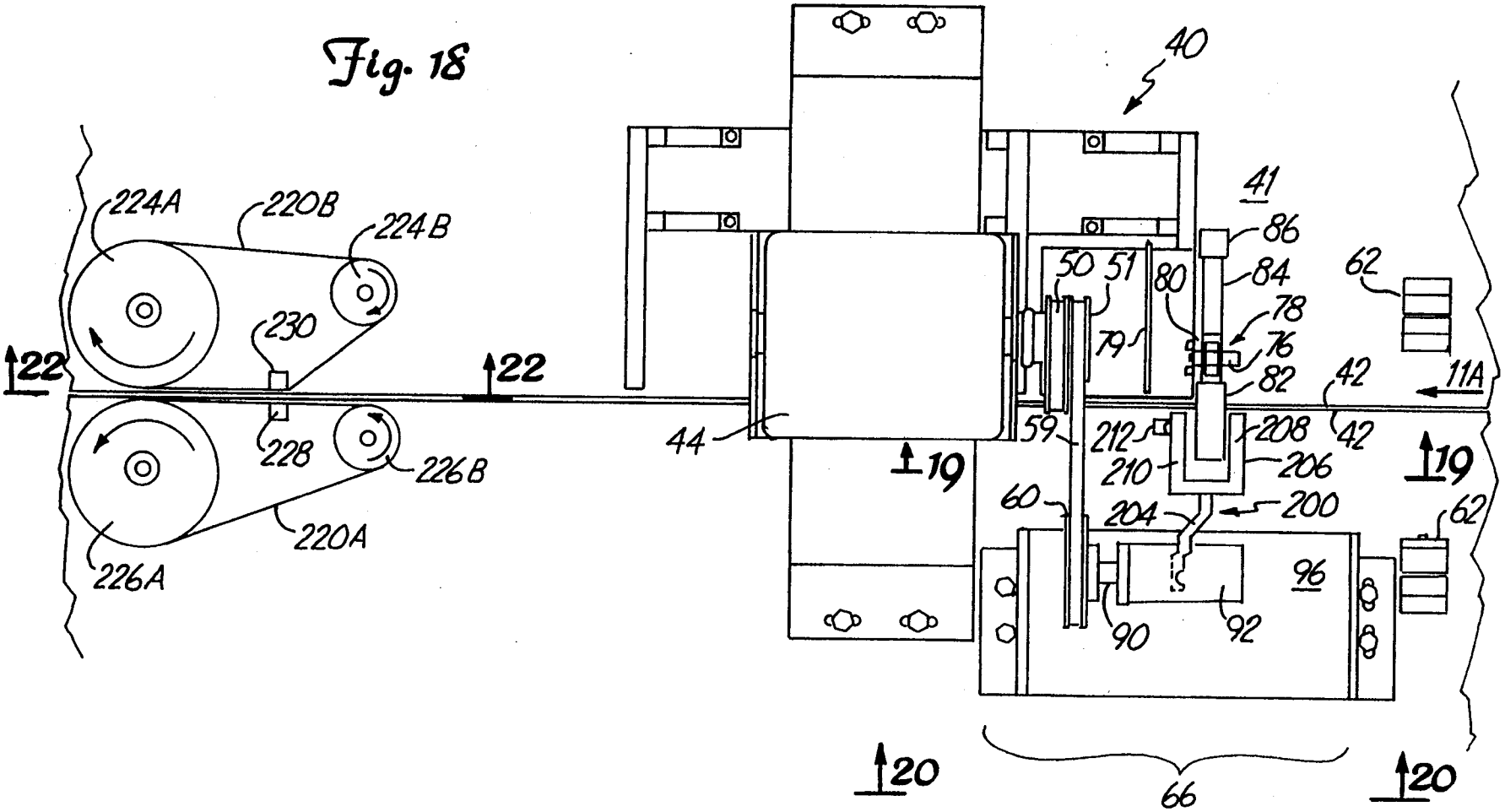
FIG. 18 is a plan view of an alternative embodiment of the tin-tie bending device of the present invention.
Figure 19:
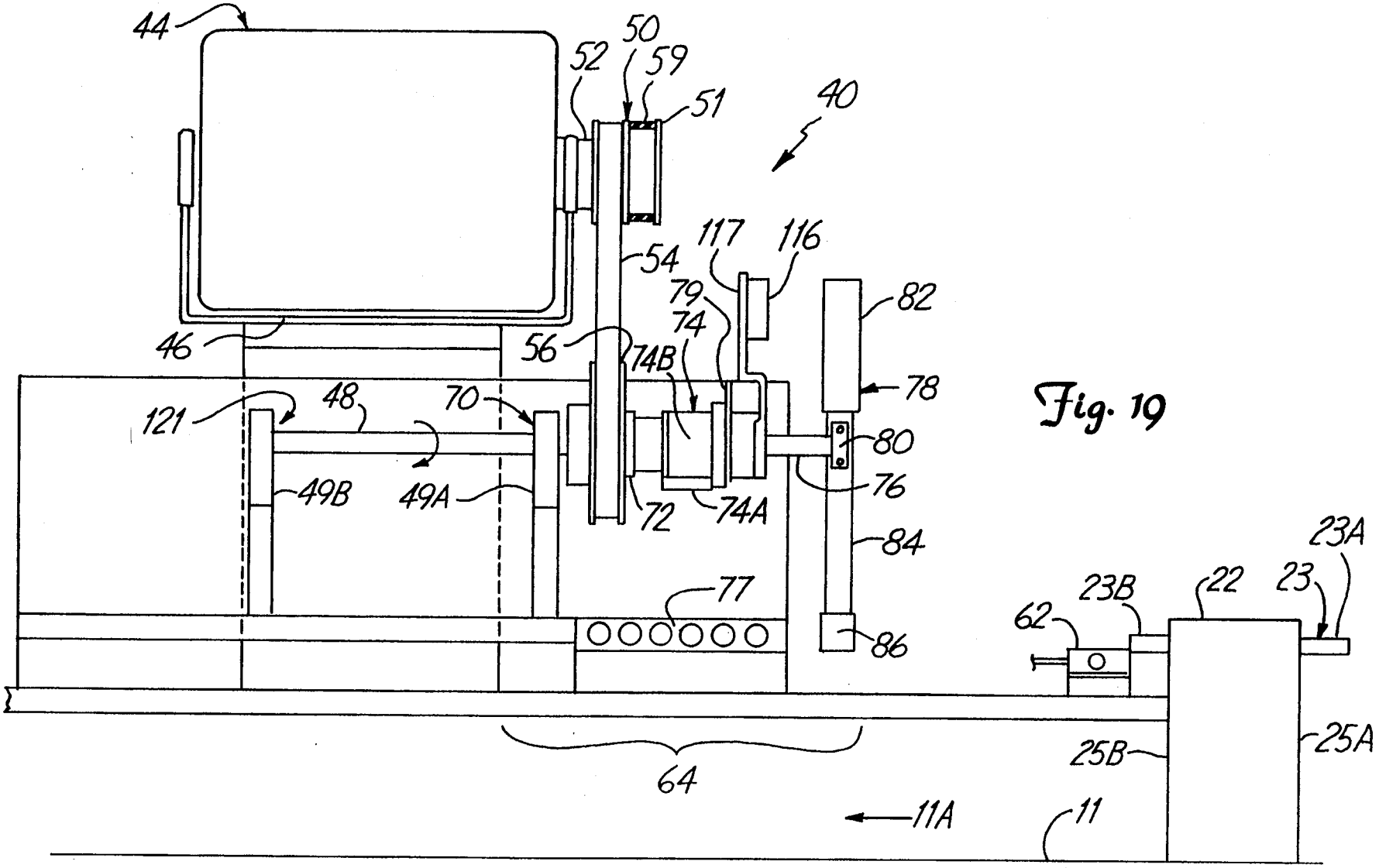
FIG. 19 is a front view in elevation of the alternative embodiment tin-tie bending device taken along line 19—19 of FIG. 18.

In an alternative embodiment of the tin-tie bending device 40 shown in FIGS. 18–22, all of the steps in bending the ends of the tin-tie 23 about the edge of the bag 25 are carried out at a single station by the first vertical bending section 64 and by the horizontal bending section 66. Accordingly, in this alternative embodiment, the second bending means (the second vertical tab bending section 122) and the second detecting means (sensors 120) are unnecessary as shown in FIGS. 18 and 19.

Figure 20:
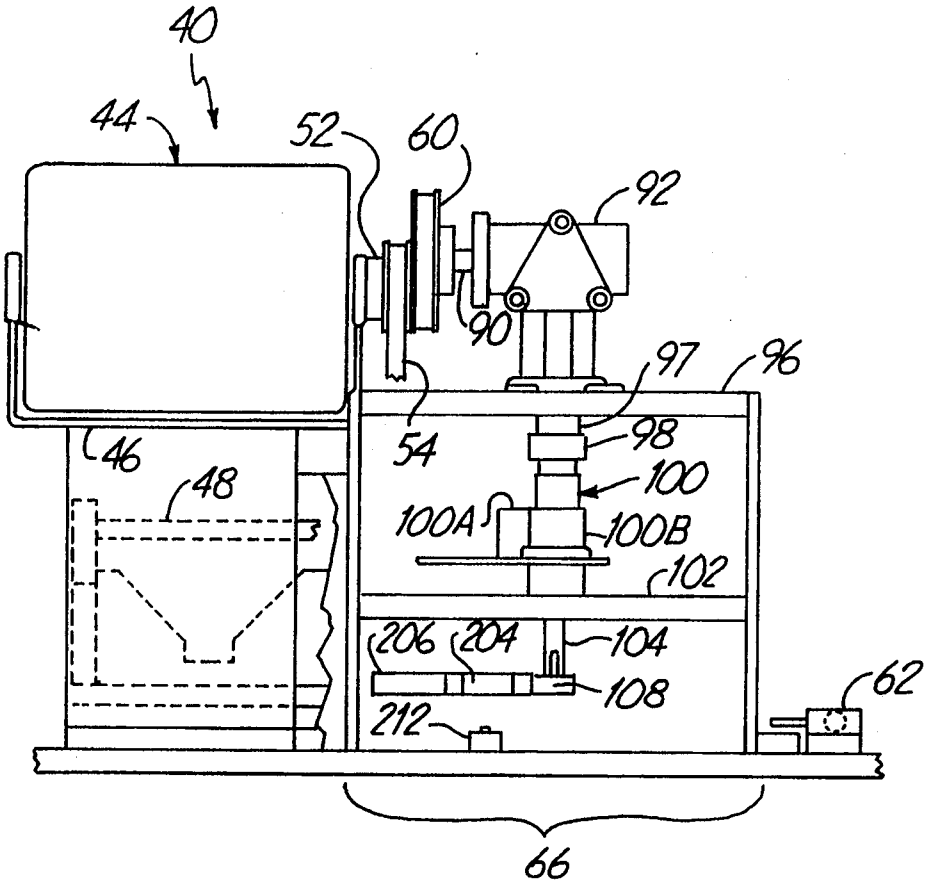
FIG. 20 is a front view in elevation of the alternative embodiment tin-tie bending device taken along line 20—20 of FIG. 18.

In addition, in this alternative embodiment, the horizontal tab bending section 66 has a paddle 200 (FIGS. 18 and 20). The paddle 200 includes an arm 204 having a two-pronged fork 206 including a first fork 208 and a second fork 210. The paddle 200, like paddle 106, rotates about a vertical axis (about the longitudinal axis of the axle 104) perpendicular to the bag travel path 11A so that the paddle 200 sweeps a path in a direction adjacent the bag travel path. The paddle 200 is of a length such that the ends of the first fork 208 and the second fork 210 are closely adjacent the travel path 11A when the paddle 200 is in a stationary position, and so that the ends of the first fork 208 and second fork 210 pass closely adjacent to bag 22 when the paddle 200 is moving. The first fork 208 and second fork 210 are spaced transversely from each other sufficiently to allow the paddle 78 of the vertical tab bending section 64 to pass through or between the first prong 208 and the second prong 210 of the paddle 200 when paddle 200 is in a stationary position (FIG. 18). An alignment sensor 212, similar to alignment sensor 118, is disposed adjacent at least a portion (e.g., second prong 210) of the paddle 200 for ensuring alignment of the paddle 200 in a proper starting and finishing position. (See FIGS. 18 and 20). In addition to the paddle 200, the horizontal tab bending section 66 has the same components as previously described in the first embodiment.

Figure 22A:
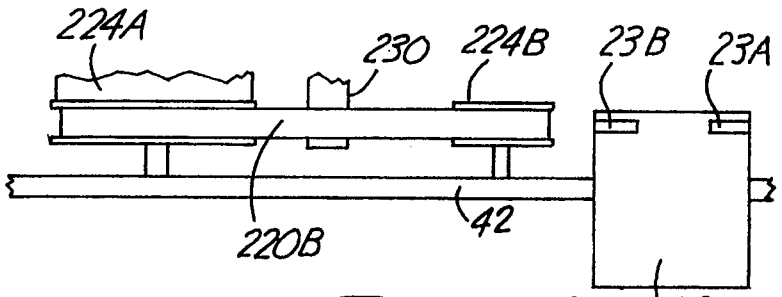
FIG. 22A is a front view in elevation of the alternative embodiment tin-tie device taken along lines 22—22 in FIG. 18.

In addition, in this alternative embodiment, the third bending means (stationary arms 150) and the fourth bending means (crimp rollers 154) are unnecessary. Instead, a pair of tin-tie engaging belts 220A and 220B disposed on opposite sides of the bag travel path 11A comprises the fourth bending means (FIGS. 18 and 22). The tin-tie engaging belt 220A is disposed about a drive pulley 226A and a pulley 226B. The tin-tie engaging belt 220B is disposed about a pulley 224B and a pulley 224B. The drive pulley 224A is driven by another pulley and belt combination (not shown), and is operably connected to pulley 226A to provide power for rotating belt 220A. As can be seen, the pulley 224B is spaced from the bag travel path 11A so that the belt 220B, in the vicinity of wheel 224B, is spaced from the bag travel path 11A and then angles toward the bag travel path to meet belt 220A in the vicinity of a pair of belt guide members 228 and 230.

The belt guide member 228 is disposed interiorly of the belt 220A to maintain the belt 220A closely adjacent the bag travel path 11A. Similarly, the belt guide member 230 disposed interiorly of the belt 220B (opposite of the belt 220A) and maintains the belt 220B closely adjacent the bag travel path 11A. Accordingly, with this relative positioning of belts 220A and 220B between the guide belt members 228 and 230, a pinch point 232 is created between the belts 220A and 220B wherein the guide belts 220A and 220B are biased toward each other to maintain about one-eight of an inch clearance between each other. Accordingly, a bag 22 passing therethrough will have a surface 222 of the belts 220 press the ends 23A and 23B of the tin-tie into secure flush engagement with the side wall of the bag 22. This effects final closure in crimping down of the tin-tie about the folded over top portion of the bag 22. The belts 220A and 220B move along the direction of bag travel and at the same speed that the bag travels.

Figure 22B:
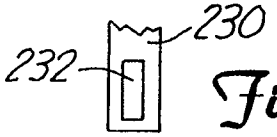
FIG. 22B is a front view in elevation schematically illustrating a portion of FIG. 22B.

The guide belt members 228 and 230 can also include a pair of rollers 232 rotatably disposed on the surface of the respective members 228 and 230 which contacts the belts 220A and 220B (FIG. 22B). The rollers 232 reduce wear on the interior of the belts 220A and 220B.

In addition, if desired, the pulleys 226A and 224A can be biased against each other to further enhance the crimping down of the tin-tie ends against the sidewall of the bag.

In use, the bag 22 enters the alternative tie bender section after having the tin-tie 23 applied along the top end of the bag 22 and secured thereon adhesively (with its ends 23A and 23B extending beyond the sides of the bag as seen in FIG. 3). As the bag 22 enters the alternative tie bender section along the conveyor 11 and through guide belts 42, the leading edge 25B of the bag 22 passes through the pair of sensors 62, breaking the beam of light passing therebetween. This sends the first signal to the solenoid 74A of the clutch assembly 74 via the controls 28. The bag 22 continues to move to the left along the conveyor 11 as seen in the FIGS. Upon the trailing edge 25A of the bag 22 passing the sensors 62, the beam of light between the sensors 62 is again reestablished, thus sending a second signal to the solenoid 74A of clutch assembly 74 via the controls 28. In addition, the second signal, although with an added time delay, is sent to the horizontal tab bender section 66, and in particular its solenoid 100A of clutch assembly 100.

A timing circuit is built into the controls 28, which can be controlled by the microprocessor, such that the solenoid 74A will actuate the wrap spring clutch 74B to initiate rotation of the paddle 78 so that the paddle contact head 86 will begin its revolution just as the leading tin-tie end 23B is moving in front of the contact head 86 and as the leading edge 25B just passes by the first fork 208 of the paddle 200. (See FIG. 21A).

While the contact head 86 of paddle 78 begins its clockwise revolution to bend tin-tie end 23B, the paddle 200 of horizontal tab bending section 66 remains stationary, with its first fork 208 acting as a further anvil or reference against which the tin-tie end 23B may be bent, thus further facilitating the displacement of the tin-tie tab end 23B at a 90° angle relative to the vertical plane of the bag 22.

Figure 21A:
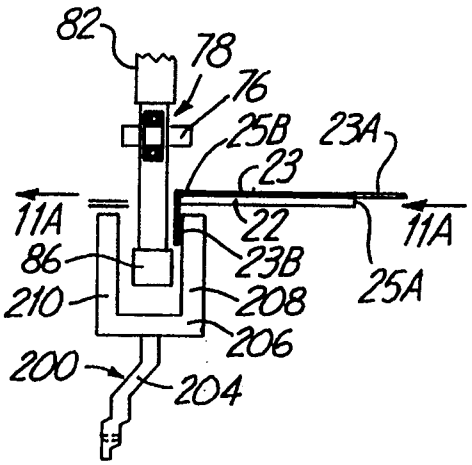
FIGS. 21A–21D are schematic representations illustrating a sequence of steps in bending ends of a tin-tie with the alternative embodiment tin-tie bending device of the present invention.
Figure 21B:
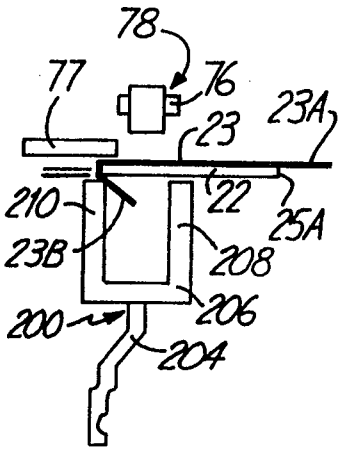
Figure 21C:
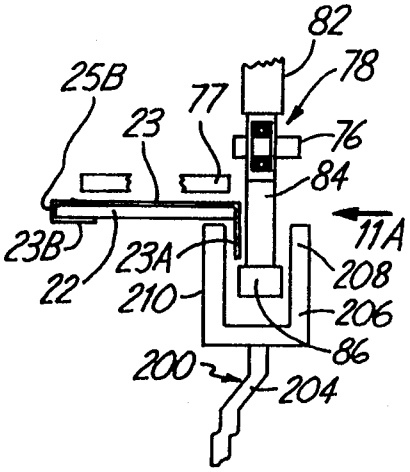

After the paddle 78 of the first vertical bending section 64 moves through and displaces the tin-tie end 23B to its 90° orientation, the bag, still moving continuously along the bag travel path 11A, encounters the second fork 210 of the stationary paddle 200 of the horizontal bending section 66. The bag 22 travels toward the second fork 210 wherein the tin-tie end 23B comes into contact with the fork 210 (FIG. 21B) which forces the tin-tie end 23B toward the sidewall of the bag 22 and into relatively flush engagement with the sidewall of the bag 22 as seen in FIG. 21C.

The magnetic section block 77 pulls the tin-tie 23 and bag firmly against the magnetic block 77 as the second fork 210 (remaining stationary) contacts the tin-tie end 23B to angularly displace it. (See FIG. 21B (top view)). The magnetic section block 77 serves as a stabilizing reference point maintaining the upper portion of the bag 22 in a generally vertical plane to accentuate the bending of tin-tie end 23B about the edge 25B of the bag 22.

Next, the bag 22 continues its continuous path along the bag travel path 11A (while still being held firmly along the magnetic section block 77). The timing circuit and CPU are designed so that when the trailing edge 25A of the bag 22 is just short of the second fork 210 of paddle 200, the paddle 78 of the vertical tab bending section 64 will begin rotating so that its contact head 86 begins its 360° revolution just as the trailing tin-tie end 23A is moving in front of the contact head 86.

The solenoid 74A actuates the wrap spring clutch 74B a second time to again initiate rotation of the paddle 78 upon the solenoid 74A receiving the second signal from the sensors 64 (via the timing circuit and CPU). Accordingly, upon actuation of clutch 74B, the contact head 86 of the first vertical tab bender section 64 moves through and displaces the tin-tie end 23A to the 90° orientation shown in FIG. 21C.

Figure 21D:
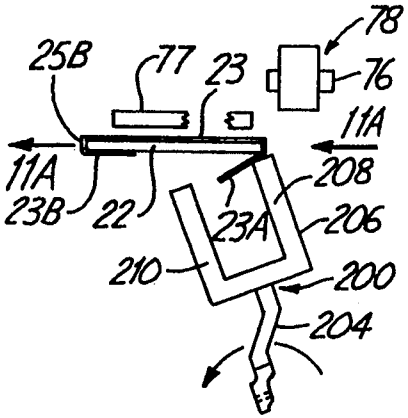

Immediately after the contact head 86 of the first vertical bender section 64 moves through and displaces the tin-tie end 23A to its 90° orientation as shown in FIG. 21C, and the paddle head 86 passes above the horizontal plane of the paddle 200, the clutch assembly 100 for the horizontal tab bending section 66 is actuated upon receipt of the second signal after a predetermined time delay from the actuation of clutch assembly 74 (allowing the contact head 86 to be out of the path of travel of paddle 200 of the horizontal tab bending section 66). Actuation of the clutch assembly 100 causes nearly instantaneous acceleration of the paddle head 206 which begins its 360° revolution and as seen in FIG. 21D, causes the first fork 208 of the paddle 200 to strike the now partially bent (about 90°) tin-tie end 23A, further bending the tin-tie end 23A about the trailing edge 25A of the bag 22. As for the first vertical tab bending operation, the magnetic section 77 holds the upper portion of the bag 22 upright during the action of the paddle 200. After striking the tin-tie end 23A, the contact head 206 of the paddle 200 continues its revolution until it completes a path of a 360° revolution whereupon the paddle contact head 206 returns to its original starting position (shown in FIG. 18).

As the respective paddles 78 and 200 bend the tin-tie ends 23A and 23B, the bag 22 is being moved continuously, i.e., without stopping, along conveyor 11 and through guide belts 42. Manipulation of the tin-tie ends 23A and 23B in this fashion is possible because of the extremely high rotation speed of the respective paddles 78 and 200 caused by the wrap spring clutches 74 and 100, respectively. Accordingly, the bag 22 need not be stopped along its path on the conveyor 11 for this bending action to take place. Moreover, the magnetic section 77 firmly holds the bag 22 without interfering with the horizontal sweep of the paddle 200 or the vertical sweep of the paddle 78.

After the tin-tie end 23A is bent about the trailing edge 25A of the bag, the bag, still moving continuously along the conveyor 11, next approaches the pair of opposed tin-tie engaging belts 220A and 220B, which further displaces the tin-tie ends 23A and 23B toward the surface of the bag sidewall. In particular, as the bag 22 approaches the tin-tie engaging belts 220A and 220B, the leading tin-tie end 23B, already in substantially flush engagement with the bag sidewall, is squeezed through the pinch point 232 of the tin-tie engaging belts between guides 228 and 230 to further squeeze the tin-tie end 23B into complete flush engagement with the bag sidewall. Similarly, as the trailing edge 25A of the bag 22 approaches the pinch point 232 of the tin-tie engaging belts 220A and 220B, the tin-tie end 23A is engaged between the belts 220A and 220B and squeezed through guides 228 and 230 to cause complete flush engagement between the tin-tie end 23A and the bag sidewall. The bag 22 then continues along the travel path 11A between the tin-tie engaging belts 220A and 220B until beyond the wheels 224A and 226A. This results in the bag 22 and tin-tie 23 having the shape shown in FIG. 17. This completes the tin-tie bending process, resulting in a bag 26 having a secure closure for a folded over top portion of the bag.

For both the first and alternative embodiments, alternative designs can be employed to actuate both the vertical and horizontal tab bending paddles. For example, instead of having a main motor 44 and using pulleys and belts to translate drive shaft rotation into line shaft 48 and into right angle gear box 92, an independent servomotor could be employed independently to drive each tab bending paddle. Accordingly, each servo motor would operate independently of the other servo motors. In this case, each paddle (78, 106, 130, 200) would be connected directly to its own servo motor capable of producing a single revolution of an axle. In this case, each servo motor would be electrically connected to the controls 28.

Other modifications to the tie-bending device 40 can include using different material for the paddle 78, 106, 130 and 200. Preferably, the paddles are formed from a hard plastic, such as nylon. However, because of the extremely high speed with which the contact head of the paddle strikes the tin-tie end 23A or 23B, some bending of the paddle arm occurs temporarily, thus somewhat reducing the force imparted to the tin-tie end. Constructing the paddle, such as paddle 78, out of a stiffer material will reduce any momentary temporary bending of arm 84 as the contact head 86 impacts tin-tie end 23A. This, of course, would further insure the proper and full 90° displacement of the tin-tie end 23A relative to the edge and vertical plane of the bag 22.

Alternatively, or along with using a stiffer material, any phenomenon of the bending of the paddle arm 84 can be alleviated by adjusting the starting position of the paddle 78 and its contact head 86 such that the contact head 86 of paddle 78 is moving some distance, such as an eighth or quarter revolution of its 360° revolution before contacting the tin-tie end 23A. This would allow the contact head 86 to have a "head start" before impacting the tin-tie end 23A. This would aid in counter-effecting any phenomenon of the arm 84 bending upon starting acceleration. As seen in the side view, instead of having the paddle 78 have a starting and ending position that is vertical as shown (FIG. 5), the starting position could be as shown in phantom position B wherein the contact head 86 would start about ⅛ of a revolution counter-clockwise from its present starting position as shown in position A.

Although the present figures for the first embodiment show the tin-tie 23 being on a side of the bag 22 closest to the vertical tab bending sections, the bag may be moved through the tin-tie bending section having an opposite orientation wherein the tin-tie 23 is secured on the side of the bag closest to the horizontal tab bending section. This would result in the tin-tie ends 23A and 23B being bent back onto a main portion 23C of the tin-tie 23 instead of around the respective edges (25A and 25B) of the bag 22.

In addition, in the first embodiment, the tin-tie engaging belt mechanism shown in FIGS. 18–22 can be substituted for the pair of crimp rollers 154.

The tin-tie bending device of the present invention has several advantages. The present invention provides for continuous movement of a bag on travel path along a conveyor during the bending of tin-ties about the bag. Moreover, the rotatable paddles for bending tin-tie ends can be controlled independently of the speed of the conveyor 11 (wherein the timing circuit and CPU automatically account for the speed of the conveyor) because the bending means is triggered by sensing the edge of the bag. This allows the device to handle changes in bag width without reprogramming the timing or speed of the bending means and without changing the speed of the conveyor to accommodate a changed bag size. Moreover, a magnetic block insures stabilization of the bag while bending the tin-tie end 23A or 23B. Paddle alignment sensors insure that the paddle is always in proper position at start up before a first cycle of operation. The connection via CPU 29 between the bending means and detecting means allows an operator to control the distance between the fold line of the tin-tie end and the edge of the bag. Moreover, this adjustment of the fold line location can be controlled for the leading edge and respective tin-tie end independently of the trailing edge and respective tin-tie end.

Although the present invention has been described with reference to preferred embodiments, workers skilled in the art will recognize that changes may be made in form and detail without departing from the spirit and scope of the invention.

What is claimed is:

1. A tie fastener bending device for use with a packaging container having a tie-fastener secured thereon wherein a leading end and a trailing end of the tie fastener extends beyond a leading edge and a trailing edge, respectively, of the packaging container, the bending device comprising:

means for moving the packaging container and for maintaining the packaging container in a generally vertical plane as the container moves along a travel path from a first end of the device to a second end of the device;

means for detecting the leading edge and the trailing edge of the packaging container traveling past the detecting means, the first detecting means producing a first signal upon detection of the leading edge of the packaging container and producing a second signal upon detection of the trailing edge of the packaging container, the detecting means being disposed between the first and second ends of the device along the packaging container travel path;

first means for bending the leading end and the trailing end of the tie fastener relative to the respective leading edges and trailing edges of the packaging container, the first bending means including a first paddle being capable of selectively rotating in a generally vertical plane transversely across the travel path of the container perpendicular to the generally vertical plane of the container to contact the end of the tie, the first bending means being spaced from and independent of the detecting means and being electrically connected to the detecting means so that the first bending means is selectively actuated in response to the first signal from the detecting means to bend the leading end of the tie fastener and selectively actuated in response to the first signal from the detecting means after a predetermined delay to bend the trailing end of the tie fastener, the first bending means being disposed between the detecting means and the second end of the device at a first location along the container travel path; and second means for bending the trailing end of the tie fastener relative to the trailing edge of the packaging container, the second bending means including a second paddle being capable of selectively rotating in a generally horizontal plane perpendicular to the generally vertical plane of the packaging container along the direction of container travel to contact the trailing end of the tie, the second bending means being spaced from and independent of the detecting means and being electrically connected to the detecting means so that the second bending means is selectively actuated in response to the second signal from the detecting means, the second bending means being disposed at the first location along the container travel path adjacent to and on an opposite side of the container travel path relative to the first bending means.

2. A method for bending a pair of ends of a tie fastener about a packaging container having the fastener secured thereon wherein a leading end and a trailing end of the tie fastener extend beyond a leading edge and a trailing edge of the container, respectively, the method comprising the steps of:

moving the container continuously on a travel path from a first end to a second end of the path and maintaining an upper portion of the container in a first plane along the travel path;

providing a first paddle adjacent the travel path, the first paddle including a first end and a second end and being capable of selectively rotating in a second plane substantially perpendicular to the first plane defined by the container;

providing a second paddle adjacent the travel path, the second paddle including a first end and a second end and being capable of selectively rotating in a third plane substantially perpendicular to the first plane defined by the container, the second paddle being located adjacent to the first paddle and on an opposite side of the container travel path relative to the first paddle;

detecting the leading edge of the container as the container moves along the travel path and producing a first signal indicating detection of the leading edge;

detecting the trailing edge of the container as the container moves along the travel path and producing a second signal indicating detection of the trailing edge;

rotating the first paddle a first time, as the leading end of the tie fastener moves along the container travel path past the first paddle, to sweep a path transversely across the container travel path to strike the leading end of the tie fastener and bend the leading end of the tie fastener relative to the leading edge of the container, the first paddle rotating after a first predetermined time delay in response to the first signal;

rotating the first paddle a second time, as the trailing end of the tie fastener moves along the container travel path past the first paddle, to sweep a path transversely across the container travel path to strike the trailing end of the tie fastener and bend the trailing end of the tie fastener relative to the trailing edge of the container, the first paddle rotating after a second predetermined time delay in response to the first signal; and rotating the second paddle, as the trailing end of the tie fastener moves along the container travel path away from the second paddle, to sweep a path adjacent the container travel path to strike the trailing end of the tie fastener and further bend the trailing end of the tie fastener relative to the trailing edge of the container, the second paddle rotating after a predetermined time delay in response to the second signal.

3. The method of claim 2 wherein the step of providing the second paddle further includes providing the second paddle with the first end defining a fork having a first prong and a second prong, and wherein the step of rotating the first paddle further includes the first end of the first paddle passing between the first and second prongs of the second paddle as the first paddle sweeps its path transversely across the container travel path.

4. The method of claim 3 and, after the second detecting step, further including the step of:

orienting the second paddle so that the first and second prongs of the second paddle are substantially perpendicular to and adjacent to the first plane defined by the container as the first paddle rotates the first time, the first prong being positioned to act as an anvil to support the container in a generally upright position while the first paddle strikes the leading end of the tie fastener.

5. The method of claim 3 and, after the first rotating step, further including the step of:

orienting the second paddle so that the first and second prongs of the second paddle are substantially perpendicular to and adjacent to the first plane defined by the container, the second prong being positioned to further bend the leading end about the leading edge of the container as the leading edge of the container moves past the second prong of the second paddle.

6. The method of claim 3 and, after the first rotating step, further including the step of:

orienting the second paddle so that the first and second prongs of the second paddle are substantially perpendicular to and adjacent to the first plane defined by the container, the second prong being positioned to act as an anvil to support the container in a generally upright position while the first paddle rotates the second time to strike the trailing end of the tie fastener.

7. A tie fastener bending device for use with a packaging container having a tie-fastener secured thereon wherein an end of the tie fastener extends beyond an edge of the packaging container, the bending device comprising:

means for moving the packaging container and for maintaining an upper portion of the packaging container in a first plane as the container moves along a travel path from a first end to a second end of the device;

first means for bending the end of the tie fastener relative to the edge of the packaging container, the first bending means including a first paddle capable of selectively rotating in a second plane transversely across the travel path of the container perpendicular to the :first plane of the container to contact the end of the tie fastener, the first bending means being disposed between first end and the second end of the device at a first location along the container travel path; and second means for bending the end of the tie fastener relative to the edge of the packaging container, the second bending means including a second paddle capable of selectively rotating in a third plane perpendicular to the first plane of the packaging container along the direction of the container travel to contact the end of the tie fastener, the second bending means being disposed at the first location along the container travel path adjacent to and on an opposite side of the container travel path relative to the first bending means.

8. The device of claim 7 wherein the second paddle includes a first end and a second end, the first end defining a fork including a first prong and a second prong, the second prong being spaced from and substantially parallel to the first prong so that the first paddle can pass between the first prong and the second prong of the second paddle as the first paddle strikes the end of the tie fastener, the second paddle remaining in a stationary position during rotation of the first paddle through the fork of the first end of the second paddle.

9. The device of claim 8 and further comprising:

means for detecting the packaging container traveling past the detecting means, the detecting means disposed along the container travel path between the first end of the device and the first bending means;

wherein the first and second bending means are spaced from and independent of the detecting means, the first and second bending means being electrically connected to the detecting means and being selectively actuated in response to a signal from the detecting means.

10. The device of claim 7 and further comprising:

means for magnetically attracting and holding a metallic component of the tie fastener of the packaging container against the magnetic means as the packaging container moves past the magnetic means along the travel path to maintain the upper portion of the packaging container in a generally vertical plane while the bending means bends the end of the tie fastener relative to the edge of the packaging container, the magnetic means being disposed adjacent the first bending means and generally opposite the first prong of the second paddle.

11. The device of claim 7 wherein the first bending means further includes: a clutch assembly including:

a clutch connected to the first paddle for causing rotation of the first paddle; and a solenoid for causing actuation of the clutch, the solenoid being actuated by a signal from the detecting means.

12. The device of claim 11 wherein the clutch is capable of selectively rotating the paddle for a single revolution at a rate of 1200 revolutions per minute.

13. The device of claim 11 and further comprising:

an alignment sensor electrically connected to the clutch assembly and disposed adjacent the second paddle to detect the orientation of the second paddle relative to the alignment sensor to insure proper positioning of the second paddle prior to rotation of the first paddle to contact the tie-fastener, wherein the alignment sensor selectively sends a signal to actuate the clutch assembly and rotate the first paddle until the second end of the second paddle is in alignment with the alignment sensor.

14. The device of claim 7 wherein the first bending means further includes: a motor connected to the first paddle for causing rotation of the first paddle, the motor being capable of selectively causing a single high speed revolution of the first paddle and being controlled by a microprocessor.

* * * * *